United States Patent [19]

Persico

[11] Patent Number: 4,923,191

[45] Date of Patent: May 8, 1990

[54] MOUNTAIN CLIMBER FITNESS MACHINE

[76] Inventor: Joseph Persico, 1530 Pennsylvania Ave., Apt. 12-F, Brooklyn, N.Y. 11239

[21] Appl. No.: 258,006

[22] Filed: Oct. 14, 1988

[51] Int. Cl.[5] ..... A63B 23/06

[52] U.S. Cl. ..... 272/69; 272/70; 272/112

[58] Field of Search ..... 272/69, 70, 96, 112, 272/129

[56] References Cited

U.S. PATENT DOCUMENTS

| | | | |
|---|---|---|---|
| 4,643,418 | 2/1987 | Bart | 272/69 |
| 4,687,195 | 8/1987 | Potts | 272/69 |
| 4,708,338 | 11/1987 | Potts | 272/69 X |
| 4,749,181 | 6/1988 | Pittaway et al. | 272/69 |
| 4,771,148 | 9/1988 | Bersonnet | 272/69 X |

FOREIGN PATENT DOCUMENTS

| | | | |
|---|---|---|---|
| 2006887 | 9/1971 | Fed. Rep. of Germany | 272/112 |
| 3502127 | 7/1986 | Fed. Rep. of Germany | 272/69 |
| 1227215 | 4/1986 | U.S.S.R. | 272/69 |
| 1245324 | 7/1986 | U.S.S.R. | 272/69 |

OTHER PUBLICATIONS

PC450 Power Climb, Equipnews, May/Jun. 1988.

*Primary Examiner*—Richard J. Apley
*Assistant Examiner*—Joe H. Cheng
*Attorney, Agent, or Firm*—Richard L. Miller

[57] ABSTRACT

This climbing machine is designed for a user to simulate mountain climbing. Primarily, it consists of a motor driven sprocket train mounted in a housing, and a pair of chains on the sprockets are provided with rungs for the user to climb. The machine further includes a safety device that will automatically stop the operation of the machine in the event that the user missteps or suffers an ailment while using the machine.

2 Claims, 1 Drawing Sheet

FIG. 1
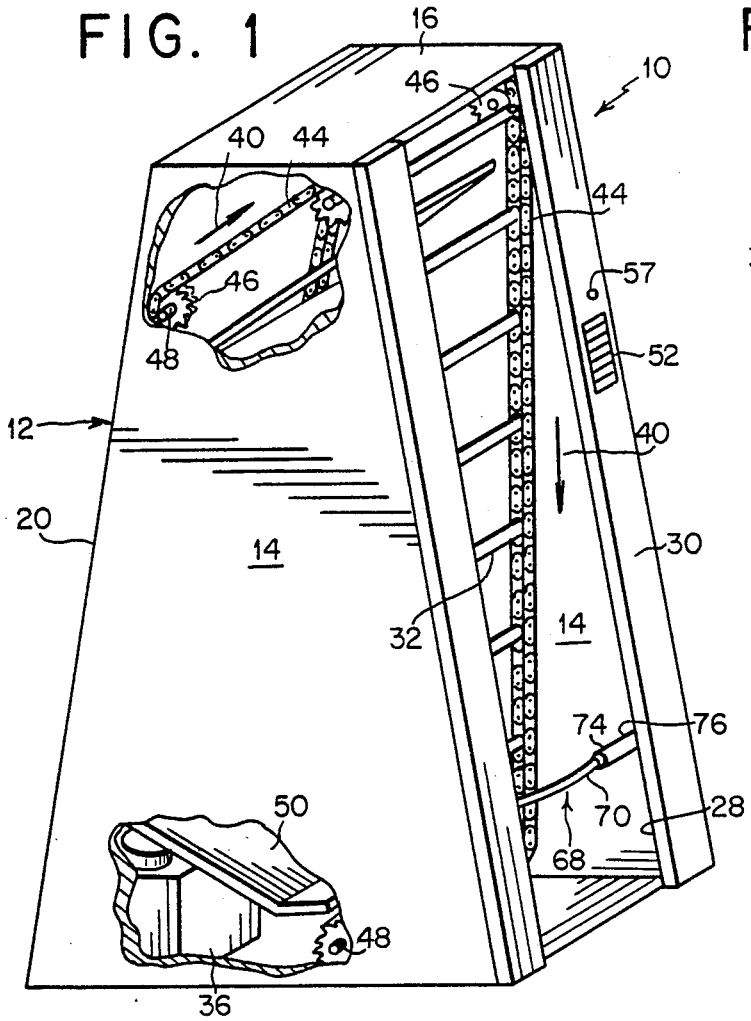
FIG. 2
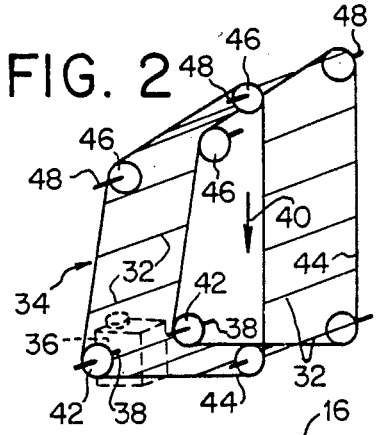
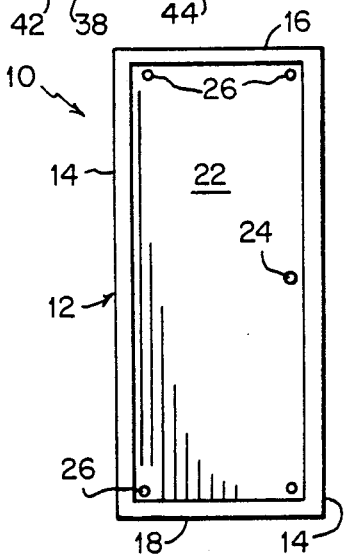
FIG. 3
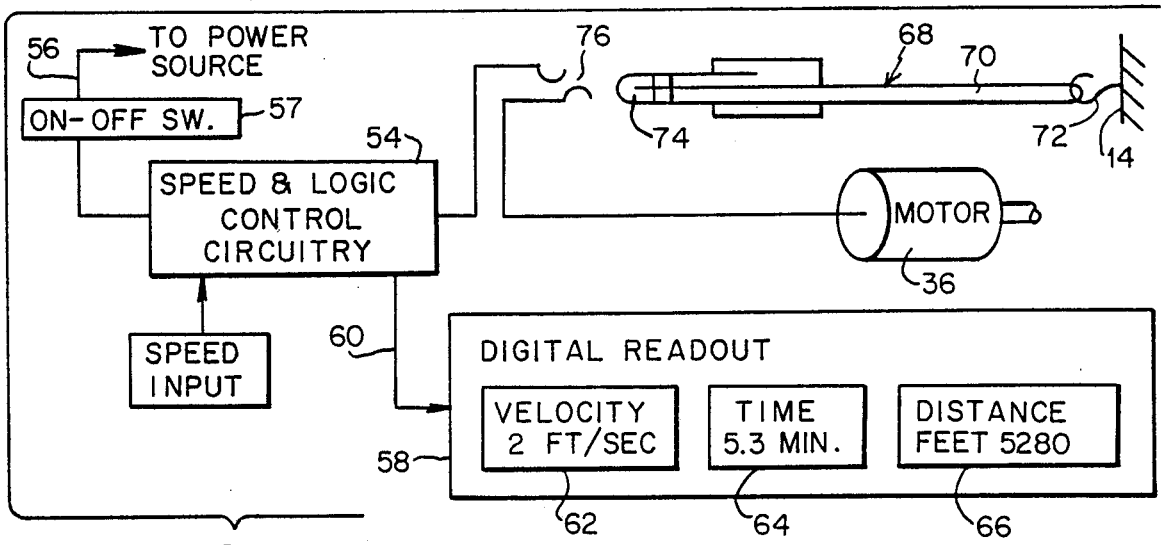
FIG. 4

MOUNTAIN CLIMBER FITNESS MACHINE

BACKGROUND OF THE INVENTION

The instant invention relates generally to physical fitness machines, and more particularly, to a mountain climber fitness machine.

Numerous ladder devices have been provided in the prior art that are adapted to for rescue of people during the event of fire emergencies. For example, U.S. Pat. Nos. 918,333 of Kobb; 688,147 of Zajicek; and 480,518 of Roberts, all are illustrative of such prior art. While these units may be suitable for the particular purpose to which they address, they would not be as suitable for the purpose of the present invention as hereafter described.

SUMMARY OF THE INVENTION

A primary object of the present invention is to provide a mountain climber fitness machine that will overcome the shortcomings of the prior art devices.

Another object is to provide a mountain climber fitness machine that will be of such design, as to simulate climbing for muscular and cardiovascular trailing.

An additional object is to provide a mountain climber fitness machine that will be of such design, as to be electrically operated and speed controlled.

A further object is to provide a mountain climber fitness machine that is simple and easy to use.

A still further object is to provide a mountain climber fitness machine that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention shown with parts broken away to illustrate some construction details;

FIG. 2 is a diagrammatic perspective view of the sprocket train of the invention;

FIG. 3 is a rear elevational view of the invention; and

FIG. 4 is a block diagram of the required circuit.

DETAILED DESCRIPTION OF THE PREFERRED EMBODIMENTS

Turning now descriptively to the drawings, in which like reference characters denote like elements throughout the several views, a machine 10 is shown to include a housing 12 having side walls 14, a top wall 16, a bottom wall 18, and a rear wall 20 having an inspection panel 22 with a key operated lock 24 therein, and fasteners 26 provided for securing panel 22 in rear wall 20. An opening 28 provided through front wall 30 provides access to the equally spaced apart rubber covered rungs 32 of a sprocket train 34 enclosed within housing 12 that is driven by an electric motor 36 mounted to the bottom wall 18. The motor 36 has incorporated in its housing appropriate gear train speed reduction system (not shown) so as to produce shaft revolution in a correct order of magnitude as to be suitable for the present invention.

The arrows 40 indicate the direction of travel of sprocket train 34, and the pair of motor shafts 38 of motor 36 are secured in the drive sockets 42 of sprocket train 34, and a pair of endless chains 44 are received on the driven sprockets 46 secured to shafts 48 suitably mounted to the inside surfaces of the side walls 14 of housing 12. The rubber coated rungs 32 are secured to and between the chains 44, and a cover panel 50 is provided and secured at its side edges to the side walls 14, so as to conceal the rungs 32 and motor 36 in the rear of housing 12 from the user.

An electronic program panel 52 is provided on one side of the front wall 30, and includes some of the circuitry shown in FIG. 4. A speed and logic control circuitry unit 54 is provided and is energized by a power source at 56 through an on-off switch 57. The output of speed and logic control circuitry unit 54 is coupled to a digital readout unit 58 by line 60, and the digital readout unit 58 includes a visual window 62 for the readout of velocity in feet per second, as well as a window 64 for the readout of time in minutes and fractions thereof, and a window 66 for the readout of distance traveled in feet.

Referring now to FIGS. 1 and 4, a safety device 68 is provided for the automatic disconnect of the power in the event that a user should misstep or should suffer a sudden ailment while using machine 10.

Safety device 68 includes a wire 70 looped at one end and freely received in a hook 72 fastened to the inside of one of the side walls 14, and the other ends of the wire 70 are fixedly secured in a male plug jack 74 which is normally plugged into a female plug jack 76 that is wired in series with another output of the speed and logic control circuitry unit 54 and the drive motor 36 of the machine 10. The jacks 74 and 76 when coupled, enables completion of the power circuit to the motor 36, and if the user trips the wire 70 it will unplug the jacks 74 and 76, thus opening the circuit of the machine and prevents the user from becoming seriously injured.

In operation the switch 57 is first turned on, causing the motor 36 to operate the sprocket train 34, and through the panel 52 the user may select any speed mode desired. The user then climbs the descending rungs 32. The digital readout unit 58 is employed by the user at any time at the panel 52.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A mountain climber fitness machine, comprising : a housing for enclosing a motor operated sprocket train, rubber coated rungs secured to said sprocket train containing a speed and logic control circuitry unit connected through an on-off switch to a power source, digital readout means secured in said panel and coupled to said unit for displaying velocity, time and distance travelled, and a safety device secured in said housing for stopping said motor operated sprocket train in the event the user missteps or suffers a sudden ailment, wherein said motor is mounted to a bottom wall of said housing and includes a pair of output shafts, one on each end of said motor, a drive sprocket of said sprocket train is secured to said motor output shafts, an endless chain is received on each said drive sprocket, driven sprockets secured on shafts are secured to side walls of said housing, the rungs are secured in spaced apart relation to and between each said endless chain for said user to climb, and said safety device includes a wire looped at one end, the looped wire is received on a hook secured in one side wall of said housing and other end of said wire is secured in a male plug jack normally received in a female jack secured in another side wall of said housing, said female jack being wired in series with an output of said speed and logic control circuitry unit and said motor so that when said male plug jack is pulled and disconnected from said female jack by said user misstep, current to said motor ceases and causing said machine to stop operate, so as to prevent said user from becoming seriously injured.

2. A mountain climber fitness machine, comprising : a housing, a motor enclosed by the housing, the housing including spaced apart vertical side walls defining opposite sides of a front user access opening, rubber coated rungs extending cross the opening and operatively connected to the motor for sequential vertical movement along a continuous closed path extending downwardly and then rearwardly of the opening for a user to step on sequentially, a panel secured to said housing containing a speed and logic control circuitry unit connected through an on-off switch to a power source, digital readout means secured in said panel and coupled to said unit for displaying velocity, time and distance travelled, and a safety device secured in said housing containing said speed and logic control circuitry unit connected through said on-off switch to said power source for stopping movement of said motor operated rungs in the event the user missteps or suffer a sudden ailment, wherein the safety device includes a wire looped at one end, the looped wire is received on a hook secured in one side wall of said housing and the other end of said wire is secured in a male plug jack normally received in a female jack secured in another side wall of said housing to extend across the user access opening in front of the rungs and adjacent a lower end and said female jack is wired in series with an output of said speed and logic control circuitry unit and said motor so that when said male plug jack is pulled and disconnected from said female jack by said user misstep, current to said motor ceases and causing said machine to stop operate, so as to prevent said user from becoming seriously injured.

* * * * *